US006750874B1

(12) United States Patent
Kim

(10) Patent No.: US 6,750,874 B1
(45) Date of Patent: Jun. 15, 2004

(54) DISPLAY DEVICE USING SINGLE LIQUID CRYSTAL DISPLAY PANEL

(75) Inventor: Young-Sun Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 47 days.

(21) Appl. No.: 09/706,356

(22) Filed: Nov. 6, 2000

(30) Foreign Application Priority Data

Nov. 6, 1999 (KR) ..... 1999-49104
Nov. 2, 2000 (KR) ..... 2000-65046

(51) Int. Cl.[7] ..... G09G 5/02

(52) U.S. Cl. ..... 345/600; 348/453; 348/455; 348/742

(58) Field of Search ..... 345/87–89, 97, 345/593, 600, 603, 665, 690; 348/444, 453, 455, 742, 790, 791

(56) References Cited

U.S. PATENT DOCUMENTS

| | | | | |
|---|---|---|---|---|
| 4,574,636 A | | 3/1986 | Satake | |
| 4,907,862 A | * | 3/1990 | Suntola | 350/345 |
| 5,309,170 A | | 5/1994 | Takashi et al. | |
| 5,512,948 A | | 4/1996 | Iwamatsu | |
| 5,568,283 A | * | 10/1996 | Mitsutake et al. | 359/53 |
| 5,781,265 A | | 7/1998 | Lee | |
| 5,884,991 A | | 3/1999 | Levis et al. | |
| 5,929,843 A | | 7/1999 | Tanioka | |
| 6,025,885 A | | 2/2000 | Deter | |
| 6,104,446 A | | 8/2000 | Blankenbecler et al. | |
| 6,122,028 A | | 9/2000 | Gilmour et al. | |

FOREIGN PATENT DOCUMENTS

| | | |
|---|---|---|
| EP | 0 342 835 | 11/1989 |
| EP | 0 541 295 A2 | 12/1993 |
| JP | 63-085523 | 4/1988 |
| JP | 11006980 | 1/1990 |
| JP | 03-036518 | 2/1991 |
| JP | 05-241551 | 9/1993 |
| JP | 07-333574 | 12/1995 |
| JP | 8168039 | 6/1996 |
| JP | 8294138 | 11/1996 |
| JP | 9090402 | 4/1997 |
| JP | 10023445 | 1/1998 |
| JP | 10123477 | 5/1998 |
| JP | 10148885 | 6/1998 |
| WO | WO 91/10223 | 11/1990 |
| WO | WO 96/26613 | 1/1996 |

OTHER PUBLICATIONS

An Office action issued by the Japanese Patent Office on Dec. 16, 2003 in Applicant's corresponding Japanese patent application No. 2000–338231.

* cited by examiner

*Primary Examiner*—Kent Chang
*Assistant Examiner*—Tom Sheng
(74) *Attorney, Agent, or Firm*—Robert E. Bushnell, Esq.

(57) ABSTRACT

A display device adopting a single liquid crystal display (LCD) panel, by which a decrement in luminance is reduced using only a single liquid crystal device, is provided. Accordingly, a degradation in color saturation due to an increase in luminance caused by the addition of an achromatic color is compensated for by a four-color conversion algorithm, even when an image is displayed using a single LCD panel or a ferroelectric liquid crystal (FLC) panel. Hence, the brightness of a screen increases compared to the prior art, and more distinct colors can be displayed.

65 Claims, 6 Drawing Sheets

DISPLAY DEVICE USING SINGLE LIQUID CRYSTAL DISPLAY PANEL

CLAIM OF PRIORITY

This application makes reference to, incorporates the same herein, and claims all benefits accruing under 35 U.S.C. § 119 from an application entitled Display Device Using Single Ferroelectric Liquid Crystal Display Panel earlier filed in the Korean Industrial Property Office on Nov. 6, 1999, and there duly assigned Ser. No. 49104/1999, and an application entitled Display Device and Method Using Single Liquid Crystal Display Panel earlier filed in the Korean Industrial Property Office on Nov. 2, 2000, and there duly assigned Ser. No. 65046/2000.

BACKGROUND OF THE INVENTION

1. Field of the Invention

The present invention relates to a display device, and more particularly, to a display device using a single liquid crystal display panel, by which a reduction in luminance is minimized using a single liquid crystal device.

2. Description of the Related Art

Existing types of display devices that are driven in a digital system include plasma display panels (PDP), liquid crystal display (LCD) panels and ferroelectric liquid crystal (FLC) panels.

FLC panels have a structure in which ferroelectric liquid crystal is sandwiched between an optical planar mirror formed on a silicon substrate and glass, and have a wide viewing angle and a fast response speed compared to existing panels.

A display device using a single LCD panel according to the art related to the present invention is made up of a signal processing unit, a timing control unit, an optical engine and a screen. The optical engine is made up of a color switch, an FLC panel, and an optical system having an optical source, a collimating lens, a polarized beam splitter and a projection lens.

The signal processing unit receives R (red), G (green) and B (blue) signals, controls the offset, contrast and brightness of the received signals, performs signal processing such as gamma correction, and then generates R, G, and B data in synchronization with a vertical synchronization signal on a field-by-field basis to display R, G, and B data on the LCD panel. The timing control unit receives a vertical synchronization signal and a horizontal synchronization signal, and generates a color switching control signal for controlling the color switch. In the optical engine, light emitted from the optical source is split into R, G, and B light beams. The R, G, and B light beams are sequentially transmitted using the color switch, the transmitted R, G, and B light beams are transmitted or reflected by the LCD panel according to the R, G, and B data, and then the light beams are displayed on the screen via the optical system.

In order to display colors using a single LCD panel, in the art, R, G, and B colors time-share one vertical period, and each is displayed for one third of a vertical period. As shown in FIG. 2, the quantity of light of each of the R, G, and B light beams is ⅓, and the output time of light of each of the R, G, and B light beams is also ⅓, so that the maximum luminance, which is the sum of the products of the quantity of each light by the output time of each light, is ⅓.

The maximum brightness in the art related to the present invention is just about ⅓ of the maximum brightness when three LCD panels are used to display R, G, and B colors, respectively. Therefore, a screen appears dark due to a reduction in luminance.

Exemplars of the art are U.S. Pat. No. 6,122,028 issued to Gilmour et al. for REFLECTIVE LIQUID CRYSTAL DEVICE WITH POLARIZING BEAM SPLITTER, U.S. Pat. No. 6,104,446 issued to Blankenbecler et al. for COLOR SEPARATION OPTICAL PLATE FOR USES WITH LCD PANELS, U.S. Pat. No. 6,025,885 issued to Deter for PROCESS FOR COLOR TRANSFORMATION AND A COLOR VIDEO SYSTEM, U.S. Pat. No. 5,929,843 issued to Tanioka for IMAGE PROCESSING APPARATUS WHICH EXTRACTS WHITE COMPONENT DATA, U.S. Pat. No. 5,884,991 issued to Levis et al. for LCD PROJECTION SYSTEM WITH POLARIZATION DOUBLER, U.S. Pat. No. 5,781,265 issue to Lee for NON-CHIRAL SMECTIC C LIQUID CRYSTAL DISPLAY, U.S. Pat. No. 5,512,948 issued to Iwamatsu for NEGATIVE-IMAGE SIGNAL PROCESSING APPARATUS, U.S. Pat. No. 5,309,170 issued to Takashi et al. for HALF-TONE REPRESENTATION SYSTEM AND CONTROLLING APPARATUS, U.S. Pat. No. 4,574,636 issued to Satake for APPARATUS FOR EXAMINING AN OBJECT BY USING ULTRASONIC BEAMS, JP10123477 issued to Yoneda et al. for LIQUID CRYSTAL PROJECTOR, JP10023445 issued to Semasa for PICTURE DISPLAY DEVICE, JP 8294138 issued to Ozuru et al. for LIQUID CRYSTAL PROJECTOR, JP 10148885 (EP 0843487) issued to Endo et al. for PROJECTOR APPARATUS, JP 9090402 issued to Takigawa et al. for PICTURE DISPLAY DEVICE, JP 11006980 issued to Miyashita for PROJECTION DEVICE, and JP 8168039 issued to Nomura et al. for PROJECTION DISPLAY SYSTEM AND PROJECTION POSITION ADJUSTING METHOD. I have found that the art does not teach a display device having a single liquid crystal display that has the image quality and luminance of the present invention.

SUMMARY OF THE INVENTION

To solve the above problem, an objective of the present invention is to provide a display device adopting a single liquid crystal display (LCD) panel, by which a reduction in luminance is improved to half the luminance when three LCD panels are used, although just one LCD panel is used.

It is another object to have a single ferroelectric liquid crystal panel, by which a reduction in luminance is improved over multiple ferroelectric liquid crystal panels.

It is yet another object to have an algorithm for converting R/G/B signal to a R/G/B/W(white) signal that allows for improved luminance.

It is still yet another object to increase luminance by adding an achromatic color to an input signal of image projecting device.

To achieve the above objectives, the present invention provides a display device using a single LCD panel, the device includes a format conversion unit for receiving signals Ri, Gi and Bi corresponding to one vertical period and generating signals Ro, Go, Bo and W (white), which have been compensated for in a loss in color saturation using a display panel control signal and a predetermined arithmetic algorithm, at intervals of one vertical period; and an optical engine for sequentially outputting four color signals to a screen in accordance with the signals Ro, Go, Bo and W output from the format conversion unit, under the control of the display panel control signal.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENT

Figure 1:
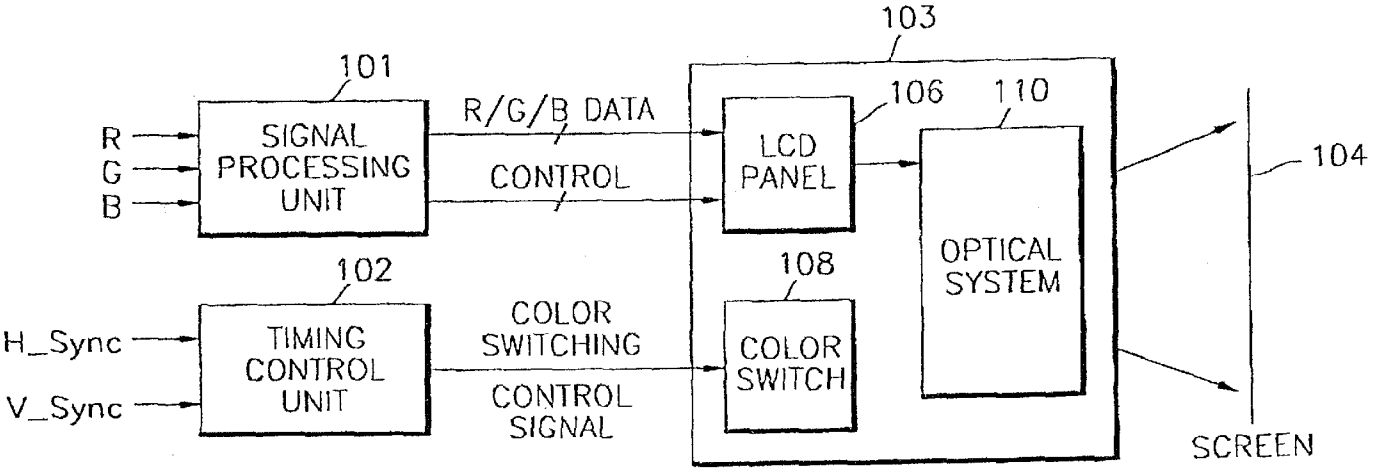
FIG. 1 (PRIOR ART)
FIG. 1 is a block diagram illustrating the structure of a conventional display device using a single liquid crystal display (LCD) panel.

As shown in FIG. 1, a display device using a single LCD panel according to the art related to the present invention is made up of a signal processing unit 101, a timing control unit 102, an optical engine 103 and a screen 104. Here, the optical engine 103 is made up of a color switch 108, an LCD panel 106, and an optical system 110 having an optical source, a collimating lens, a polarized beam splitter and a projection lens.

The signal processing unit 101 receives R, G, and B signals, controls the offset, contrast and brightness of the received signals, performs signal processing such as gamma correction, and then generates R, G, and B data in synchronization with a vertical synchronization signal on a field-by-field basis to display R, G, and B data on the LCD panel.

The timing control unit 102 receives a vertical synchronization signal and a horizontal synchronization signal, and generates a color switching control signal for controlling the color switch 108.

In the optical engine 103, light emitted from the optical source is split into R, G, and B light beams, the R, G, and B light beams are sequentially transmitted using the color switch 108, the transmitted R, G, and B light beams are transmitted or reflected by the LCD panel according to the R, G, and B data, and then the light beams are displayed on the screen 104 via the optical system.

Figure 2:
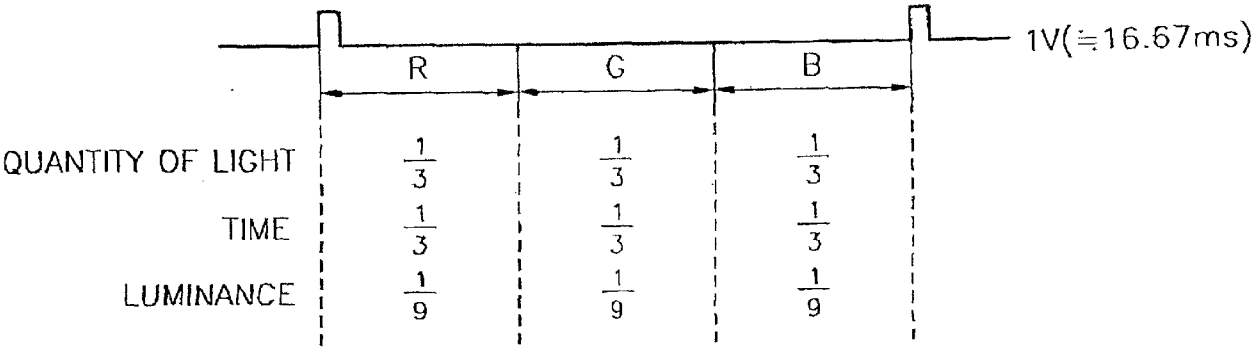
FIG. 2 (PRIOR ART)
FIG. 2 shows the quantity of light, the time of light, and the luminance of light in a conventional three-color sequence system.

In order to display colors using a single LCD panel, in the prior art, R/G/B colors time-share one vertical period, and each is displayed for one third of a vertical period. As shown in FIG. 2, the quantity of light of each of the R, G, and B light beams is ⅓, and the output time of light of each of the R, G, and B light beams is also ⅓, so that the maximum luminance, which is the sum of the products of the quantity of each light by the output time of each light, is ⅓.

That is, the maximum brightness in the art related to the present invention is just about ⅓ of the maximum brightness when three LCD panels are used to display R, G, and B colors, respectively. Therefore, a screen appears dark due to a reduction in luminance.

Figure 3:
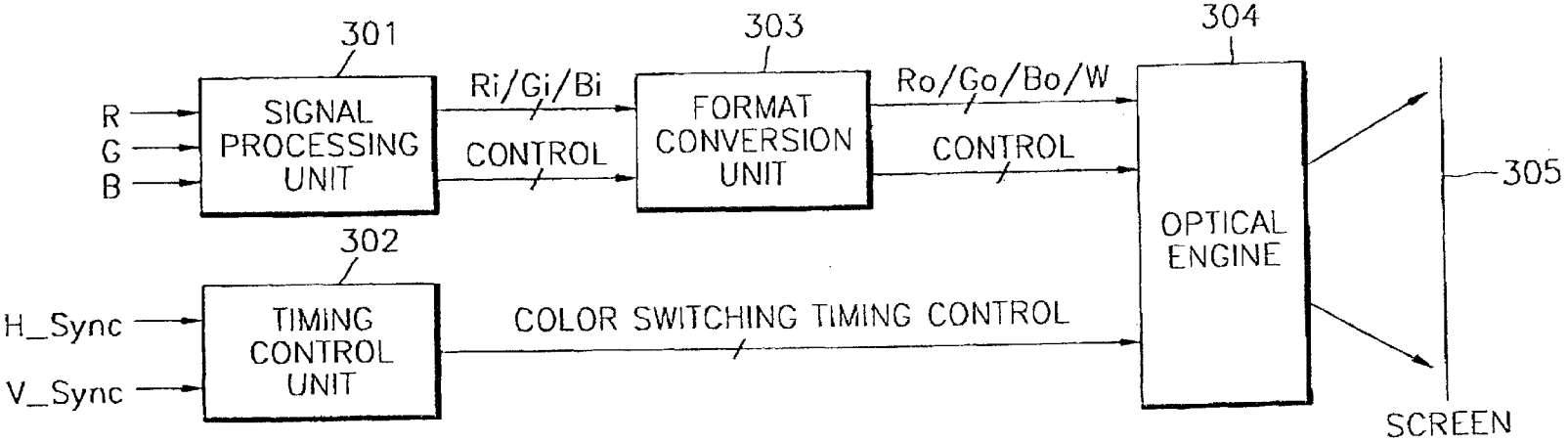
FIG. 3 is a block diagram illustrating the structure of a display device using a single FLC panel according to the present invention.

As shown in FIG. 3, a display device using a single liquid crystal display (LCD) panel according to the present invention includes a signal processing unit 301, a timing control unit 302, a format conversion unit 303, an optical engine 304 and a screen 305. The optical engine 304 is made up of a single LCD panel.

Figure 5:
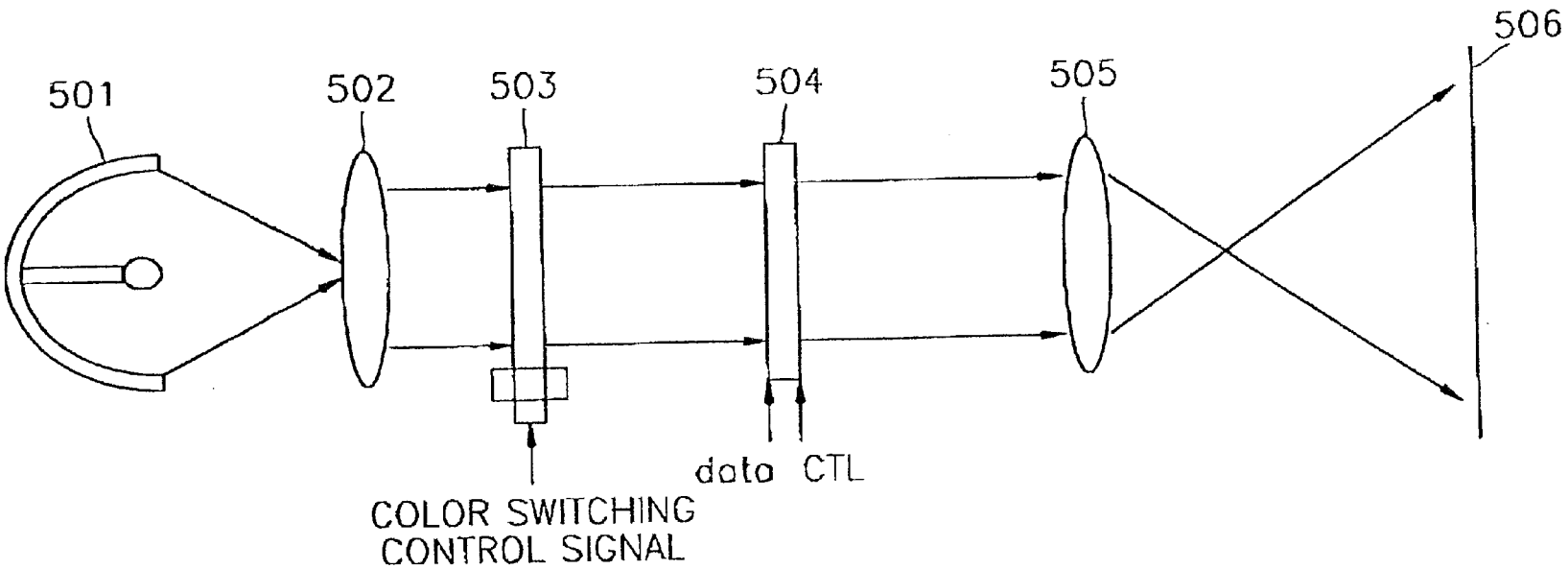
FIG. 5 is a detailed configuration view of a first embodiment of the optical engine of FIG. 3.

To be more specific, as shown in FIG. 5, a first embodiment of the optical engine 304 includes an optical source 501, a collimating lens 502, a color switching unit 503, a liquid crystal display (LCD) panel 504, and a projection lens 505.

Figure 6:
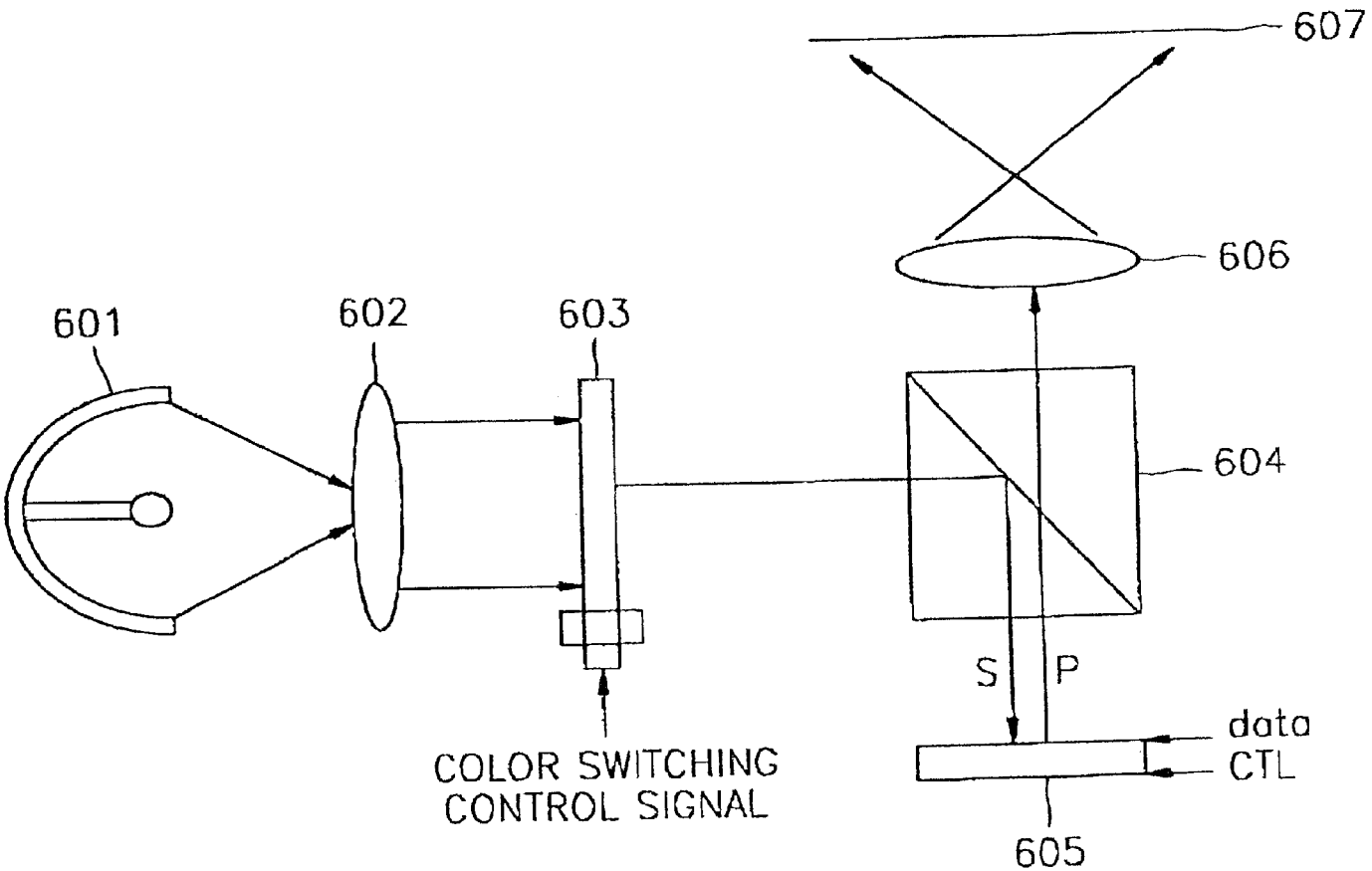
FIG. 6 is a detailed configuration view of a second embodiment of the optical engine of FIG. 3.

As shown in FIG. 6, a second embodiment of the optical engine 304 includes an optical source 601, a collimating lens 602, a color switching unit 603, a polarized beam splitter 604, a ferroelectric liquid crystal (FLC) panel 605, and a projection lens 606.

The signal processing unit 301 receives R, G, and B signals, controls the offset, the contrast and the brightness, performs signal processing such as gamma correction, and outputs an Ri/Gi/Bi signal corresponding to a 3-color sequence display system.

The timing control unit 302 receives a vertical synchronization signal (V_Sync) and a horizontal synchronization signal (H_Sync), and generates a switching control signal for controlling the color switching unit.

The format conversion unit 303 converts the received Ri/Gi/Bi signal into an Ro/Go/Bo/W signal using a four-color sequence conversion algorithm.

Figure 4:
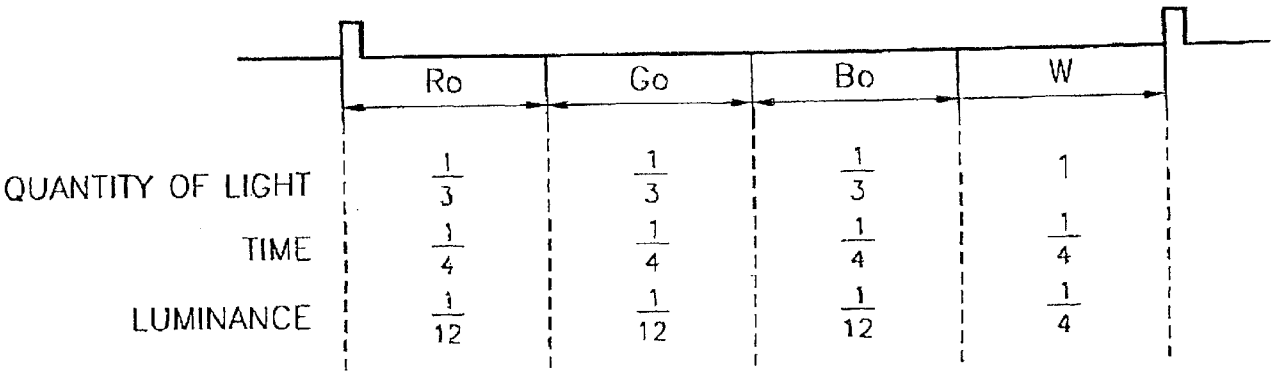
FIG. 4 shows the quantity of light, the time of light and the luminance of light in a four-color sequence system according to the present invention.

As shown in FIG. 4, the maximum brightness obtained by an image displaying method based on an Ro/Go/Bo/W four-color sequence conversion algorithm is the sum of the products of the quantity of light Ro, Go, Bo and W by the time for the four light beams, so that it can be calculated as in Equation 1:

$$\begin{aligned} Y\max 1 &= ((1/3)\times(1/4)) + ((1/3)\times(1/4)) + \\ &\quad ((1/3)\times(1/4)) + (1\times(1/4)) \\ &= 1/2 \end{aligned} \tag{1}$$

Meanwhile, the maximum luminance (Ymax2) in an image displaying method based on a conventional R/G/B 3-color sequence algorithm shown in FIG. 2 is the sum of the products of the quantity of light by the time for R, G, and B, so that it can be calculated as in Equation 2:

$$\begin{aligned} Y\max 2 &= ((1/3)\times(1/3)) + ((1/3)\times(1/3)) + \\ &\quad ((1/3)\times(1/3)) \\ &= 1/3 \end{aligned} \tag{2}$$

It can be seen from Equations 1 and 2 that the maximum brightness (Ymax1) obtained by an image displaying method based on the Ro/Go/Bo/W 4-color sequence algorithm according to the present invention is improved 50% from the maximum brightness obtained in an image displaying method based on the conventional R/G/B three-color sequence display system.

However, simple addition of only an achromatic color W to Ri/Gi/Bi without a change in the received Ri/Gi/Bi signal improves the brightness of the luminance, but the color is transited to an achromatic color, degrading the color saturation.

Figure 7:
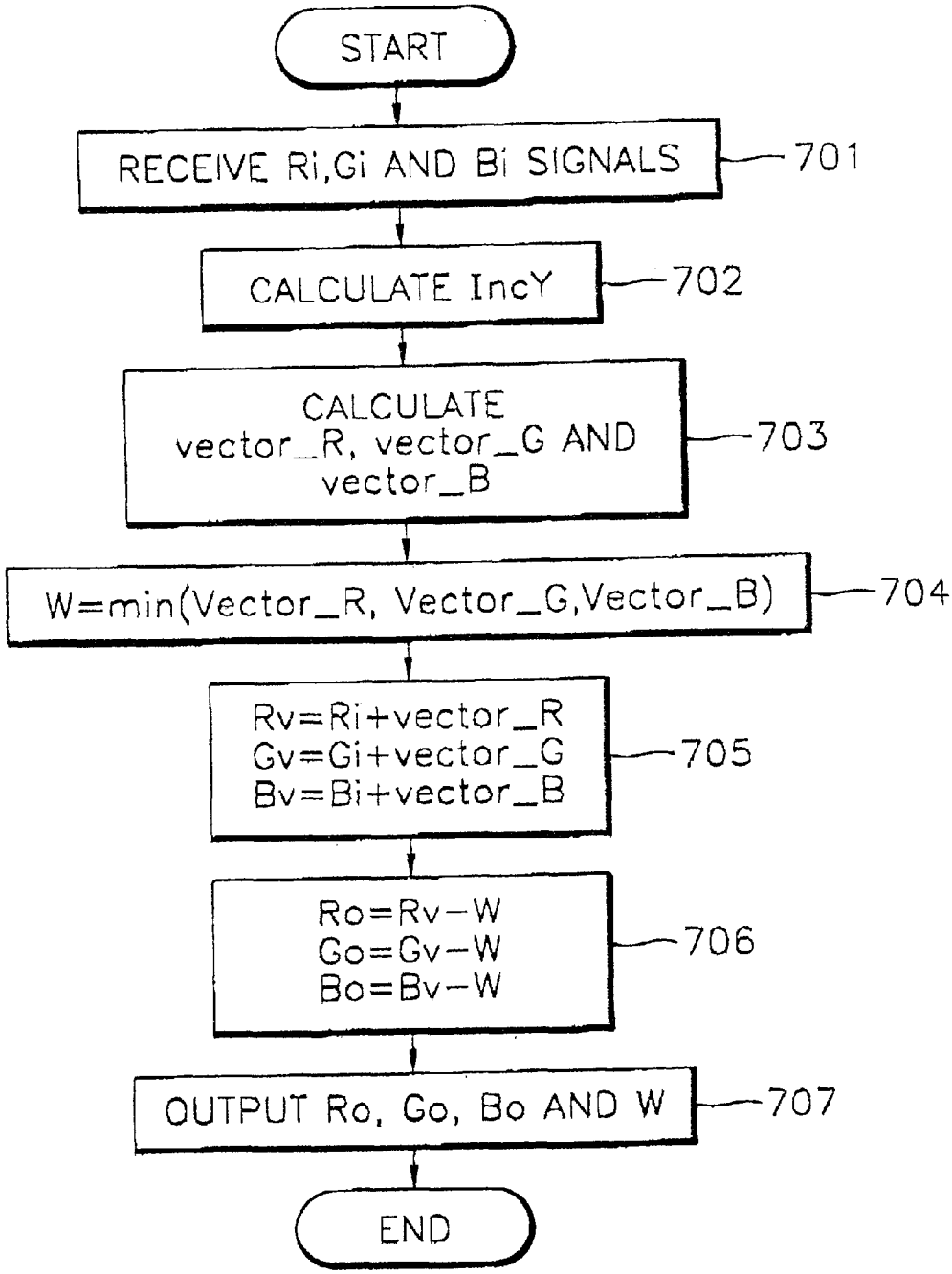
FIG. 7 is a flowchart illustrating an algorithm for converting three colors into four colors, which is applied to the present invention.

The transition of an output color in the vector direction of an achromatic color W due to the addition of the achromatic color W is prevented by an Ro/Go/Bo/W four-color sequence conversion algorithm which is performed in the format conversion unit 303, which will now be described referring to FIG. 7.

When Ri, Gi and Bi signals are received in step 701, an IncY value for determining an increment of the luminance is calculated by Equation 3 or 4, in step 702:

$$IncY = \mathrm{MIN}(Ri, Gi, Bi) \tag{3}$$

$$IncY = MEAN(Ri, Gi, Bi) \tag{4}$$

That is, the IncY value can be the minimum value selected among the values Ri, Gi and Bi or the average of Ri, Gi and Bi.

Then, values of vector_R ($\vec{v}R$), vector_G ($\vec{v}G$), and vector_B ($\vec{v}B$) are calculated as shown in Equations 5, 6 and 7, in step 703:

$$\vec{v}R = \mathrm{IncY}\cdot\mathrm{sel}\cdot(Ri/\sqrt{(Ri\cdot Ri)+(Gi\cdot Gi)+(Bi\cdot Bi)}) \tag{5}$$

$$\vec{v}G = \mathrm{IncY}\cdot\mathrm{sel}\cdot(Gi/\sqrt{(Ri\cdot Ri)+(Gi\cdot Gi)+(Bi\cdot Bi)}) \tag{6}$$

$$\vec{v}B = \mathrm{IncY}\cdot\mathrm{sel}\cdot(Bi/\sqrt{(Ri\cdot Ri)+(Gi\cdot Gi)+(Bi\cdot Bi)}) \tag{7}$$

The term sel denotes a scale constant, which can be obtained experimentally depending on the characteristics of a system. When sel is too large, it may be impossible that the system expresses the values of vectors $\vec{v}R$, $\vec{v}G$ and $\vec{v}B$, and when sel is two small, the effect of improvement in luminance may be reduced due to small brightness compensation. Thus, it is experimentally effective to optimally determine sel within $1 \leqq \mathrm{sel} \leqq \sqrt{3}$.

Thereafter, the minimum value among the values of $\vec{v}R$, $\vec{e}G$ and $\vec{v}B$ is determined as the value of an achromatic color W to be used in the four-color sequence display system, in step 704.

Through this process, the achromatic color W to be added in order to improve the luminance is obtained.

In step 705, a transition of an input color in the achromatic color vector direction due to the addition of an achromatic color W is compensated for by the operations as shown in Equations 8, 9 and 10:

$$Rv = Ri + \vec{v}R \tag{8}$$

$$Gv = Gi + \vec{v}G \tag{9}$$

$$Bv = Bi + \vec{v}B \tag{10}$$

In steps 706 and 707, Ro, Go and Bo, which are compensated for in the transition in the achromatic color vector direction, are calculated by Equations 11, 12 and 13, and output:

$$Ro = Rv - W \tag{11}$$

$$Go = Gv - W \tag{12}$$

$$Bo = Bv - W \tag{13}$$

According to the above algorithm, the luminance is increased due to the addition of an achromatic color W and due to the addition of the values of $\vec{v}R$, $\vec{e}G$, and $\vec{v}B$ to the input signals Ri, Gi and Bi, respectively, as shown in Equations 8, 9 and 10. Also, the transition of an input color in the achromatic color vector direction is compensated for so that the input color becomes distant from the achromatic color vector direction, by subtracting the value of an added achromatic color W from each of the values Rv, Gv and Bv as in Equations 11, 12 and 13.

Figure 8:
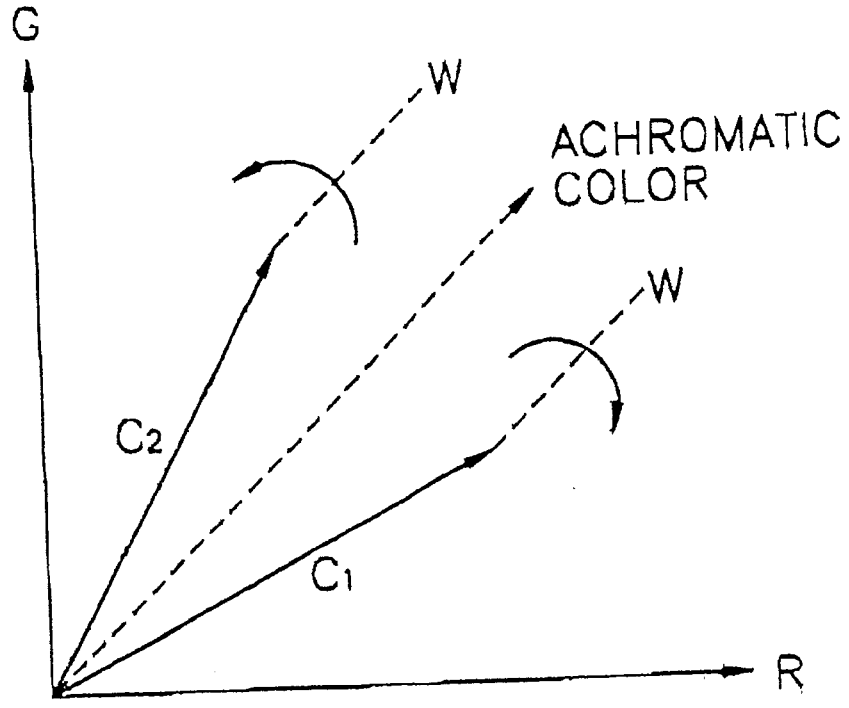
FIG. 8 shows a color vector diagram for explaining a four-color conversion algorithm according to the present invention.

That is, as shown in FIG. 8, the Ro/Go/Bo/W four-color conversion algorithm will now be described in consideration of only the R and G vectors, excluding the B vector, for convenience of explanation.

First, when the vector of an input color signal C1 is slanted in the R vector direction with respect to an achromatic color, an addition of a calculated achromatic color W to the C1 vector may cause a transition of the input color signal C1 toward the achromatic color. However, when a vector is calculated by subtracting W, which is the same as the R vector and the G vector, from the vector of the input color signal C1 multiplied by a scaling constant or the like, the input color signal C1 may be shifted in the R vector direction (indicated by an arrow on the right side). Thus, a final output synthesized vector has almost the same phase as that of the original C1 vector.

Even when an input color signal C2 is calculated using an algorithm according to the present invention by the above-described method, it is shifted in the G vector direction (indicated by the arrow on the left side). Thus, if a final synthesized vector including W is drawn, it has almost the same phase as that of the C2 vector.

The operation of applying the Ro/Go/Bo/W data, which is output from the format conversion unit 303 by this four-color conversion algorithm, to the optical engine 304 and displaying the same on the screen 305 will now be described with reference to FIGS. 5 and 6.

In the optical engine according to the first embodiment shown in FIG. 5, the optical source 501 is made up of a lamp for producing light, and a reflective mirror for reflecting light emitted from the lamp to guide the light, and radiates light.

The collimating lens 502 focuses light radiated from the optical source 501 into parallel light or focusing light.

The color switching unit 503 is an LCD shutter or a color wheel type, and receives light from the collimating lens 502 and sequentially switches and outputs four colors R, G, B and W at intervals of one quarter of a vertical period during one vertical period according to a color switching control signal received from the timing control unit 302. That is, during the first ¼ vertical period, only the wavelength of the color R among the received light is transmitted, while the remaining wavelengths are blocked. During the next ¼ vertical period, only the wavelength of the color G among the received light is transmitted, while the remaining wavelengths are blocked. Then, the wavelengths of B and W colors are sequentially switched and transmitted during the remaining two ¼ vertical periods.

The LCD panel 504 is installed on the path of light output from the color switching unit 503, and transmits incident light in accordance with the Ro/Go/Bo/W data applied by the format conversion unit 303 to the data lines of each cell formed of a matrix, under the control of a clock and panel control signal.

The projection lens 505 magnifies the light transmitted by the LCD panel 504 and projects it toward the screen 506.

A second embodiment of the optical engine will now be described with reference to FIG. 6. The first embodiment of the optical engines 304 uses transmissive LCD panels, but the second embodiment uses reflective ferroelectric liquid crystal (FLC) panels. A transmissive LCD panel displays an image by transmitting incident light corresponding to a data value input to the data line of the transmissive LCD panel, and a reflective FLC panel displays an image by reflecting incident light corresponding to a data value input to the data line of the reflective FLC panel.

In the optical engine according to the second embodiment, the optical source 601 is made up of a lamp for producing light and a reflective mirror for reflecting light emitted from the lamp to guide the light, and radiates light. The collimating lens 602 focuses light radiated from the optical source 601 into parallel light or focusing light.

The color switching unit 603 is an LCD shutter or a color wheel type, and receives light from the collimating lens 602 and sequentially switches and outputs four colors R, G, B and W at intervals of one quarter of a vertical period during one vertical period according to a color switching control signal received from the timing control unit 302. That is, during a first ¼ vertical period, only the wavelength of the color R among the received light is transmitted, while the remaining wavelengths are blocked. During the next ¼ vertical period, only the wavelength of the color G among the received light is transmitted, while the remaining wavelengths are blocked. Then, the wavelengths of the colors B and W are sequentially switched and transmitted during the remaining two ¼ vertical periods.

The polarized beam splitter 604 reflects S wave light among light received from the color switching unit 603 and guides the S wave light toward the FLC panel 605, and transmits P wave light.

The FLC panel 605 reflects incident light corresponding to the Ro/Go/Bo/W data values applied by the format conversion unit 303 to the data lines of each cell formed as a matrix, according to a clock and panel control signal, thereby displaying the image of each pixel.

Then, the polarized beam splitter 604 transmits P wave light among light reflected by the FLC panel 605 and guides the transmitted P wave light to the projection lens 606, and reflects S wave light. The projection lens 606 magnifies the light received from the polarized beam splitter 604 and projects it toward the screen 607.

Through this operation, the luminance amount to be displayed using a single LCD or FLC panel by the four-color sequence display system is increased, and a degradation in color saturation due to the addition of an achromatic color can be prevented.

The above-described optical engines have been simplified for convenience of explanation. However, it is apparent to one of ordinary skill in the optical engine designing techniques that the optical engines can further include a glass polarizer, various shutters, cubes, and the like in order to improve the quality of image such as contrast, and that the location of collimating lenses can be changed.

According to the present invention as described above, a degradation in color saturation due to an increase in luminance caused by the addition of an achromatic color is compensated for by the four-color conversion algorithm even when an image is displayed using a single transmissive LCD panel or reflective FLC panel. Hence, the brightness of a screen increases compared to the prior art, and more definite colors can be displayed.

What is claimed is:

1. A method, comprising the steps of:

receiving a plurality of color data signals in an image processing apparatus, each one of said color data signals being a distinct spectral component, said plurality of color data signals forming a color video image when combined;

determining a vector value of each one of the color data signals;

determining an initial minimum value among each said vector value;

setting a first value of an achromatic signal to have said initial minimum value among each said vector value;

determining a compensation value for each one of the color data signals by summing each said color data signal with said vector values of each one of said color data signals; and determining output color components by subtracting said first value from said compensation value for each one of the color data signals, an image displayed according to the color data signals and achromatic signal.

2. The method of claim 1, with the color data signals comprising a red signal, blue signal, and green signal.

3. The method of claim 1, further comprising the step of transmitting said output color components to project the image onto a screen through a single liquid crystal display panel.

4. The method of claim 3, with the color data signals comprising a red signal, blue signal, and green signal.

5. The method of claim 1, further comprising the step of transmitting said output color components to project the image onto a screen through a single ferroelectric liquid crystal panel.

6. The method of claim 5, with the vector value in said step of determining the compensation value comprising a product of a value of luminance of one of the color data signals, a scale constant, and second value, said second value being a quotient of one of the color data signals and square root of a sum of the squares of each color data signal.

7. The method of claim 1, further comprising the step of determining a value of luminance among each one of the color data signals.

8. The method of claim 7, with the vector value in said step of determining the compensation value comprising a product of said value of luminance, a scale constant, and a second value, said second value being a quotient of one of the color data signals and square root of a sum of the squares of each color data signal.

9. The method of claim 8, with said scale constant set according to the characteristics of the image processing apparatus.

10. The method of claim 8, with said scale constant having a value within a range between approximately 1 and square root of 3.

11. The method of claim 7, with said step of determining the value of luminance comprising calculating a minimum among each one of the color data signals.

12. The method of claim 7, with said step of determining the value of luminance comprising calculating a mean among each one of the color data signals.

13. The method of claim 1, with the plurality of color data signals divided over time in a single digital signal.

14. The method of claim 1, further comprising the step of outputting the output color components with the achromatic signal divided over time in a single digital signal, said digital signal being used by an optical engine to project the image onto a screen.

15. The method of claim 14, with said optical engine comprising at least one liquid crystal display panel or ferroelectric liquid crystal display panel.

16. The method of claim 1, with the vector value in said step of determining the compensation value comprising a product of a value of luminance, a scale constant, and a second value, said second value being a quotient of one of the color data signals and square root of a sum of the squares of each color data signal.

17. The method of claim 1, further comprising the step of transmitting said output color components to project the image onto a screen through a single one of a liquid crystal display panel and a ferroelectric liquid crystal panel.

18. The method of claim 17, further comprising the step of determining a value of luminance among each one of the color data signals.

19. The method of claim 18, with the vector value in said step of determining the compensation value comprising a product of said value of luminance, a scale constant, and a second value, said second value being a quotient of one of the color data signals and square root of a sum of the squares of each color data signal.

20. The method of claim 19, with said scale constant set according to the characteristics of the image processing apparatus.

21. The method of claim 20, with said scale constant having a value within a range between approximately 1 and square root of 3.

22. The method of claim 21, with said step of determining the value of luminance comprising calculating a minimum among each one of the color data signals.

23. The method of claim 21, with said step of determining the value of luminance comprising calculating a mean among each one of the color data signals.

24. An apparatus, comprising:

a signal processing unit receiving a plurality of color data signals and generating color data signals in synchronization, whereas the generated color data signals can form an image when combined;

a timing control unit receiving a vertical and horizontal synchronization signal, and generating a color switching control signal controlling a color switch;

a format conversion unit converting the generated color data signals into output color data signals and an achromatic signal by determining a compensation value for each of the generated color data signals by using respective vector values of the generated color data signals; and an optical engine projecting an enhanced image with the output color data signals and the achromatic signal from said format conversion unit.

25. The apparatus of claim 24, with the output color data signals including a red signal, a green signal and a blue signal and with said optical engine having a single liquid crystal display panel, said liquid crystal display panel displaying the image by transmitting incident light corresponding to the data of the red signal, green signal, blue signal, and achromatic signal.

26. The apparatus of claim 25, with said format conversion unit determining a value of luminance among each one of the red signal, green signal, and blue signal, said format conversion unit determining vector values of each one of the red signal, green signal, and blue signal, said conversion unit determining an initial minimum value among each said vector value, said format conversion unit setting a first value of an achromatic signal to have said initial minimum value among each said vector value, said format conversion unit determining a compensation value for each one of the red signal, green signal, and blue signal by summing one of the red signal, green signal, or blue signal with the respective one of said vector values, said format conversion unit determining output color components by subtracting said first value from said compensation value for each one of the red signal, green signal, and blue signal.

27. The apparatus of claim 25, said format conversion unit determining a compensation value for each one of said red, green, and blue signals by summing each of said red, green, and blue signals with vector values of each one of said red, green, and blue signals.

28. The apparatus of claim 24, with the output color data signals including a red signal, a green signal and a blue signal and with said optical engine having a single reflective ferroelectric display panel, said ferroelectric display panel displaying the image by reflecting incident light corresponding to a data value input to the data line of said reflective ferroelectric display panel.

29. The apparatus of claim 28, with said format conversion unit determining a value of luminance among each one of the red signal, green signal, and blue signal, said format conversion unit determining vector values of each one of the red signal, green signal, and blue signal, said conversion unit determining an initial minimum value among each said vector value, said format conversion unit setting a first value of an achromatic signal to have said initial minimum value among each said vector value, said format conversion unit determining a compensation value for each one of the red signal, green signal, and blue signal by summing one of the red signal, green signal, or blue signal with the respective one of said vector values, said format conversion unit determining output color components by subtracting said first value from said compensation value for each one of the red signal, green signal, and blue signal.

30. The apparatus of claim 28, said format conversion unit determining a compensation value for each one of said red, green, and blue signals by summing each of said red, green, and blue signals with vector values of each one of said red, green, and blue signals.

31. The apparatus of claim 24, with the output color data signals including a red signal, a green signal and a blue signal and with said optical engine comprising:

an optical source producing light and a reflective mirror reflecting light emitted from the light source to guide and radiate the light;

a collimating lens focusing the light radiated from the optical source into a collimated light;

a color switching unit receiving the collimated light from said collimating lens and sequentially switching and outputting the red light, green light, blue light, and white light at intervals of a certain period during one vertical period according to a color switching control signal received from said timing control unit; and a ferroelectric display panel reflecting the incident light from said color switching unit according to the red signal, green signal, blue signal, and achromatic signal applied by said format conversion unit, the reflected incident light forming the image.

32. The apparatus of claim 31, with said format conversion unit determining a value of luminance among each one of the red signal, green signal, and blue signal, said format conversion unit determining vector values of each one of the red signal, green signal, and blue signal, said conversion unit determining an initial minimum value among each said vector value, said format conversion unit setting a first value of an achromatic signal to have said initial minimum value among each said vector value, said format conversion unit determining a compensation value for each one of the red signal, green signal, and blue signal by summing one of the red signal, green signal, or blue signal with the respective one of said vector values, said format conversion unit determining output color components by subtracting said first value from said compensation value for each one of said red signal, green signal, and blue signal.

33. The apparatus of claim 31, said format conversion unit determining a compensation value for each one of said red, green, and blue signals by summing each of said red, green, and blue signals with vector values of each one of said red, green, and blue signals.

34. The apparatus of claim 24, with said optical engine comprising:

an optical source producing light and a reflective mirror reflecting light emitted from the light source to guide and radiate the light;

a collimating lens focusing the light radiated from the optical source into a collimated light;

a color switching unit receiving the collimated light from said collimating lens and sequentially switching and outputting a plurality of color light at intervals of a certain period during one vertical period according to a color switching control signal received from said timing control unit; and a liquid crystal display panel transmitting the incident light from said color switching unit according to the output color data signals, and achromatic signal applied by said format conversion unit, the transmitted incident light forming the image.

35. The apparatus of claim 24, said format conversion unit determining a compensation value for each one of the generated color data signals by summing each of the generated color data signals with vector values of each one of the generated color data signals.

36. An apparatus, comprising:

a format conversion unit converting color data signals into output color data signals and an achromatic signal; and an optical engine projecting an image with the output color data signals and achromatic signal from said format conversion unit, with said format conversion unit determining a value of luminance among each one of the plurality of color data signals, said format conversion unit determining vector values of each one of the color data signals, said conversion unit determining an initial minimum value among each said vector value, said format conversion unit setting a first value of an achromatic signal to have said initial minimum value among each said vector value, said format conversion unit determining a compensation value for each one of the color data signals by summing one of the color data signals with the respective one of said vector values, said format conversion unit determining output color components by subtracting said first value from said compensation value for each one of the color data signals.

37. An apparatus, comprising:

a signal processing unit receiving a plurality of color data signals and generating color data signals in synchronization, with the generated color data signals being able to form an image when combined;

a timing control unit receiving a vertical and horizontal synchronization signal, and generating a color switching control signal controlling a color switch;

a format conversion unit converting the generated color data signals into output color data signals and achromatic signal; and an optical engine projecting an enhanced image with the output color data signals, and the achromatic signal from said format conversion unit, with the output color data signals, and achromatic signal converted by said format conversion unit being divided over time in a single digital signal sent to said optical engine to display the image on a screen.

38. The apparatus of claim 37, said format conversion unit determining a compensation value for each one of said red, green, and blue signals by summing each of said red, green, and blue signals with vector values of each one of said red, green, and blue signals.

39. A method, comprising the steps of:

receiving a red signal, green signal, and blue signal in an image processing apparatus;

determining a value of luminance among each one of the red signal, green signal, and blue signal;

determining vector values of each one of the red signal, green signal, and blue signal;

determining an initial minimum value among each said vector value;

setting a first value of an achromatic signal to have said initial minimum value among said vector values;

determining a compensation value for each one of the red signal, green signal, and blue signal by summing one of the red signal, green signal, or blue signal with the respective one of said vector value; and determining output color components by subtracting said first value from said compensation value for each one of the red signal, green signal, and blue signal, an image displayed according to the red signal, green signal, blue signal, and achromatic signal.

40. The method of claim 39, further comprising the step of transmitting said output color components with the achromatic signal to display an image on a screen through a single liquid crystal display panel.

41. The method of claim 40, with the vector value in said step of determining the compensation value comprising a product of said value of luminance, a scale constant, and a second value, said second value being a quotient of one of said red signal, green signal, or blue signal and square root of a sum of the squares of red signal, green signal, and blue signal.

42. The method of claim 41, with said scale constant set according to the characteristics of the image processing apparatus.

43. The method of claim 42, with said scale constant having a value within a range between approximately 1 and square root of 3.

44. The method of claim 43, with said step of determining said value of luminance comprising calculating a minimum among each one of the red signal, green signal, and blue signal.

45. The method of claim 44, with said step of determining said value of luminance comprising calculating a mean among each one of the red signal, green signal, and blue signal.

46. The method of claim 39, further comprising the step of transmitting said output color components to project an image on a screen through a single ferroelectric liquid crystal panel.

47. The method of claim 39, with said step of determining a compensation value comprising a product of said value of luminance, a scale constant, and a second value, said second value being a quotient of one of said red signal, green signal, or blue signal and square root of a sum of the squares of red signal, green signal, and blue signal.

48. The method of claim 47, with said scale constant set according to the characteristics of the image processing apparatus.

49. The method of claim 48, with said step of determining said value of luminance comprising calculating a minimum among each one of the red, green, and blue signals.

50. The method of claim 48, with said step of determining said value of luminance comprising calculating a mean among each one of the red, green, and blue signals.

51. The method of claim 47, with said scale constant having a value within a range between approximately 1 and square root of 3.

52. A display device using a single liquid crystal display panel, the device comprising:

a format conversion unit receiving signals Ri, Gi and Bi and generating signals Ro, Go, Bo and W, which have been compensated for in a loss in color saturation using a predetermined arithmetic algorithm, Ro, Go, Bo being compensated for in a transition in a vector direction of W; and an optical engine sequentially outputting four color signals to a screen in accordance with the signals Ro, Go, Bo and W output from the format conversion unit, under the control of a display panel control signal.

53. The display device using a single liquid crystal display panel of claim 52, with the optical engine comprising:

an optical source generating and projecting light;

a collimating lens focusing light projected by the optical source into parallel light or focusing light;

a color switching unit receiving light from the collimating lens and sequentially switching and outputting signals R, G, B and W during one vertical period;

a liquid crystal display panel for receiving light from the color switching unit and transmitting incident light in accordance with the signals Ro, Go, Bo and W applied to the data lines of each cell formed as a matrix, under the control of the display panel control signal to display an image; and a projection lens magnifying the light transmitted by the liquid crystal display panel and projecting the magnified light toward the screen.

54. The display device using a single liquid crystal display panel of claim 53, with the color switching unit equally switching and outputting each of the signals R, G, B and W at intervals of one quarter of a vertical period during one vertical period.

55. The display device of claim 53, said format conversion unit determining a compensation value for each one of the received signals by summing each one of the received signals with vector values of each one of the received signals.

56. The display device using a single liquid crystal display panel of claim 52, with the optical engine comprising:

an optical source generating and projecting light;

a collimating lens focusing light projected by the optical source into parallel light or focusing light;

a color switching unit receiving light from the collimating lens and sequentially switching and outputting signals R, G, B and W during one vertical period;

a polarized beam splitter transmitting light received from the color switching unit or reflecting the light to change the direction of travel of the incident light, according to the polarization of the light;

a ferroelectric liquid crystal panel installed on the path of light transmitted or reflected by the polarized beam splitter, for reflecting incident to the polarized beam splitter light in accordance with the signals Ro, Go, Bo and W applied to the data lines of each cell formed as a matrix, under the control of the display panel control signal to display an image; and a projection lens magnifying the light reflected by the ferroelectric liquid crystal panel and passed through the polarized beam splitter, the projection lens projecting the magnified light toward the screen.

57. The display device using a single liquid crystal display panel of claim 56, with the color switching unit equally switching and outputting each of the signals R, G, B and W at intervals of one quarter of a vertical period during one vertical period.

58. The display device of claim 56, said format conversion unit determining a compensation value for each one of the received signals by summing each one of the received signals with vector values of each one of the received signals.

59. The display device using a single liquid crystal display panel of claim 52, with the predetermined arithmetic algorithm comprising:

obtaining a value IncY corresponding to the average value of received signals Ri, Gi and Bi;

calculating Ri, Gi and Bi unit vector components from the received signals, and multiplying each of the Ri, Gi and Bi unit vector components by the product of the value IncY and a predetermined scale value to obtain a vector R value, a vector G value, and a vector B value;

determining the minimum value among the vector R value, the vector G value, and the vector B value, as the magnitude value of an achromatic color (W); and adding the vector R value, the vector G value, and the vector B value to the received signals Ri, Gi and Bi, respectively, and subtracting the magnitude value of the achromatic color W from each of the vector R value, the vector G value, and the vector B value to generate signals Ro, Go, Bo and W.

60. The display device using a single liquid crystal display panel of claim 59, with the predetermined scale value being set within a range between approximately 1 to square root of 3.

61. A display device using a single liquid crystal display panel, the device comprising:

a format conversion unit receiving signals Ri, Gi and Bi corresponding to one vertical period and generating signals Ro, Go, Bo and W, which have been compensated for in a loss in color saturation using a display panel control signal and a predetermined arithmetic algorithm, at intervals of one vertical period; and an optical engine sequentially outputting four color signals to a screen in accordance with the signals Ro, Go, Bo and W output from the format conversion unit, under the control of the display panel control signal, with the predetermined arithmetic algorithm comprising:

obtaining a value IncY corresponding to the minimal value among received signals, Ri, Gi and Bi;

calculating Ri, Gi and Bi unit vector components from the received signals, and multiplying each of the Ri, Gi and Bi unit vector components by the product of the value IncY and a predetermined scale value to obtain a vector R value, a vector G value, and a vector B value;

determining the minimum value among the vector R value, the vector G value, and the vector B value, as the magnitude value of an achromatic color (W) signal; and adding the vector R value, the vector G value, and the vector B value to the received signals Ri, Gi and Bi, respectively, and subtracting the magnitude value of the achromatic color signal from each of the vector R value, the vector G value, and the vector B value to generate signals Ro, Go, Bo and W.

62. The display device using a single liquid crystal display panel of claim 61, with the predetermined scale value being set within a range between 1 to square root of 3.

63. An apparatus, comprising:

a format conversion unit converting color data signals into output color data signals and an achromatic signal; and an optical engine projecting an image with the output color data signals and the achromatic signal from said format conversion unit, with said format conversion unit determining a compensation value for each one of the color data signals by summing each of the color data signals with vector values of each one of the color data signals.

64. An apparatus, comprising:

a format conversion unit converting color data signals into output color data signals and an achromatic signal; and an optical engine projecting an image with the output color data signals and the achromatic signal from said format conversion unit, with said format conversion unit setting a first value of an achromatic signal said format conversion unit determining a compensation value for each one of the color data signals by summing one of the color data signals with the respective one of said vector values, said format conversion unit determining output color components by subtracting said first value from said compensation value for each one of the color data signals.

65. A display device using a single liquid crystal display panel, the device comprising:

a format conversion unit receiving signals Ri, Gi and Bi corresponding to one vertical period and generating signals Ro, Go, Bo and W, which have been compensated for in a loss in color saturation using a display panel control signal and a predetermined arithmetic algorithm, at intervals of one vertical period said format conversion unit determining a compensation value for each one of the received signals by summing each one of the received signals with vector values of each one of the received signals; and an optical engine sequentially outputting four color signals to a screen in accordance with the signals Ro, Go, Bo and W output from the format conversion unit, under the control of the display panel control signal.

* * * * *